US007908692B2

(12) United States Patent
Lange

(10) Patent No.: US 7,908,692 B2
(45) Date of Patent: Mar. 22, 2011

(54) SUPPORT FOR SUPPORTING THE NECK AND HEAD OF A HUMAN BEING

(75) Inventor: Jesper J. Lange, Skodsborg (DK)

(73) Assignee: Lasch APS, Skodsborg (DK)

( * ) Notice: Subject to any disclaimer, the term of this patent is extended or adjusted under 35 U.S.C. 154(b) by 336 days.

(21) Appl. No.: 11/886,075

(22) PCT Filed: Mar. 10, 2006

(86) PCT No.: PCT/DK2006/000137

§ 371 (c)(1),
(2), (4) Date: Aug. 28, 2008

(87) PCT Pub. No.: WO2006/094509

PCT Pub. Date: Sep. 14, 2006

(65) Prior Publication Data

US 2009/0211032 A1 Aug. 27, 2009

Related U.S. Application Data

(66) Substitute for application No. PCT/DK2006/000137, filed on Mar. 10, 2006.

(60) Provisional application No. 60/660,470, filed on Mar. 11, 2005.

(30) Foreign Application Priority Data

Mar. 11, 2005 (EP) ..... 05075603

(51) Int. Cl.
*A47C 16/00* (2006.01)

(52) U.S. Cl. ..... 5/636

(58) Field of Classification Search ..... 5/636–640, 5/630, 644

See application file for complete search history.

(56) References Cited

U.S. PATENT DOCUMENTS 2,582,571 A * 1/1952 Thoma ..... 297/397
2,589,155 A 3/1952 Smith (Continued)

FOREIGN PATENT DOCUMENTS

EP 1 228 723 A 8/2002

(Continued)

OTHER PUBLICATIONS

Russian associate's letter providing a brief description/ abstract of Russian Application No. 2007137657.

*Primary Examiner* — Fredrick Conley
(74) *Attorney, Agent, or Firm* — Harness, Dickey & Pierce, P.L.C.

(57) ABSTRACT

A support for the neck and head of a human being, such as a travel pillow, comprises a right and a left elongate support member (101,102; 201,202; 302;303; 401,402; 400A,401A; 500,502; 504,506; 906,908), and a collapsible intermediate section (100,106; 200; 300,305; 400; 510,512; 910). The support members are adapted to extend in the human being's cranial-caudal direction and to support a right and a left portion of the back head and neck, whereby the support members define left and right edges for engaging the human being's neck and mastoid bones behind the human being's ears to provide a stable support for the human being's head when the support is under pressure from the human being's head and neck. Each of the support members and the intermediate section is sufficiently bendable to conform to the natural contour of the left and right neck and head portions of the human being.

12 Claims, 8 Drawing Sheets

U.S. PATENT DOCUMENTS

| | | | | |
|---|---|---|---|---|
| 2,803,834 | A | 8/1957 | May | |
| 3,897,777 | A | 8/1975 | Morrison et al. | |
| 4,031,578 | A | 6/1977 | Sweeney et al. | |
| 4,042,278 | A | 8/1977 | Jensen et al. | |
| 4,285,081 | A | 8/1981 | Price | |
| 4,345,347 | A | 8/1982 | Kantor | |
| 4,738,488 | A * | 4/1988 | Camelio | 297/383 |
| 5,778,469 | A | 7/1998 | Festa | |
| 6,786,554 | B1 | 9/2004 | Zahiri | |
| 2001/0018777 | A1 | 9/2001 | Walpin | |

FOREIGN PATENT DOCUMENTS

| | | | |
|---|---|---|---|
| EP | 1 369 065 | A | 12/2003 |
| GB | 1 411 528 | A | 10/1975 |
| RU | 34338 | U1 | 12/2003 |

* cited by examiner

SUPPORT FOR SUPPORTING THE NECK AND HEAD OF A HUMAN BEING

This application is a National Stage application of international application number PCT/DK2006/000137 filed on Mar. 10, 2006, and claims priority under 35 U.S.C. §119 to U.S. Provisional Application No. 60/660,470 filed on Mar. 11, 2005 and to European Application No. 05075603.0 filed Mar. 11, 2005, the entire content of each of which is hereby incorporated by reference in its entirety.

TECHNICAL FIELD

The present invention relates to a support for supporting the neck and head of an individual, in particular a travel pillow supporting the individual's neck and head when resting in a high -backed seat, in a bed or on a hard surface.

BACKGROUND OF THE INVENTION

Various cushions and travel pillows have been proposed in the prior art to address the problems of supporting an individual's neck and head while resting in a seat during traveling.

For example U.S. Pat. No. 4,031,578 discloses a travel pillow comprised of three resilient sections: (1) a central section which serves as a spacer and supports the back of the user's head and (2) a matching pair of lateral head section's located on opposite sides of said spacer (1) to form a generally H-shaped configuration therewith; both of the head sections (2) being of greater thickness than spacer (1) and possessing a tapered appearance which begins with a flat and generally wide back-wall and a narrower, rounded front portion; said back-wall being disposed at an angle which slopes toward the central section so that the backward pressure of the user's head on said spacer (1) will cause the said back-walls to form an essentially parallel plane and draw the inner side-walls toward one another, for contact with the user's head.

US 2001018777 discloses a device Comprising a firm core with a first and a second lengthwise edge, a top surface and a bottom surface; a recess located on the top surface of the core; a layer of soft, viscoelastic foam located within the recess; a layer of soft, Dacron fiber located along a top surface of the layer of foam; and a soft; C shaped layer of viscoelastic foam wrapped around the core; whereby the C-shaped layer of foam covers the first lengthwise edge of the core; the bottom surface of the core, and the second lengthwise edge of the core.

U.S. Pat. No. 4,285,081 discloses a device with a generally concave shape with respect to a vertical axis of curvature corresponding approximately to the central vertebral axis of the neck. The concave shape is fashioned so that it has symmetrical left and right halves, opposing areas of which are designed to exert gentle pressure in the vicinity of the mastoid processes of the head. The surface also has a generally convex shape with respect to a horizontal axis, such axis intersecting the vertical axis of curvature, so that the generally convex shape conforms generally to at least the upper portion of the nape of the neck and the lower portion of the occipital bone of the head.

U.S. Pat. No. 4,345,347 discloses an inflatable head and neck support cushion in a modified "horseshoe" shape, designed to rest on the shoulders of a person relaxing or working in a semi-reclining position in any hospital bed, passenger seat or high-backed chair; such that the head and neck are received by the interior middle portion of the "horseshoe", such middle portion permanently embodying the contour of the back of the head and neck of a person, the two tips of the "horseshoe" being long enough to extend over the shoulders of the person and widely enough disposed apart from one another so that there is unrestricted circulation of air to the sides of the neck and face of the person, the "horseshoe" tips containing at their extremities tiny weights, slightly heavier than the inflated middle portion of the "horseshoe", in order to stabilize the entire cushion on the shoulders of a person.

U.S. Pat. No. 5,778,469 discloses a concave pillow member having a back portion, and a pair laterally opposing arcuate side portions being extended from said back portion, said back portion having an arcuate surface; wherein said back portion and said arcuate side portions define a concavity for accepting the neck of a person for supporting the cervical spine, a pivot pin connecting each of said arcuate side portions to said back portion in a manner permitting pivoting into a stationary position of each of said side portions relative to said back portion and the other of said side portions.

U.S. Pat. No. 6,786,554 discloses an apparatus to support the curve of the posterior aspect of the upper and lower portion of the neck and upper thoracic portion of the spine and behind the ears to provide support to these areas so that the head and neck will remain in a supported position while the individual is asleep. The device also provides a residing area for the skull supporting the weight of the head posteriorly.

Despite the achievements of the prior art devices, none of them provide a support which all in one

- is capable of conforming its shape including its left and right support members to the natural lordotic curvature of the neck and head of individuals of various sizes and forms thereby providing a full support of the neck and head all the way from the bottom of the neck to the occipital ridge and the mastoid bones behind the ears;
- is capable of comfortably holding the head and neck in a motionless position in a given natural resting position i.e. with the head in a straight forward position or in various sideward turned and tilted positions;
- does not occupy space between the fixed support surface (e.g. the back-rest of the chair) and the back head of the individual;
- is capable of providing an upright support of the occipital ridge of the head preventing the head from dropping too far backwards but without pushing the head too far forward;
- is capable of being easily adapted to support the neck and head of a seated human being whose head rise above the head-rest of a seat;
- is discrete in use and does not touch the cheeks or jaws and does not cover the ears of the human being;
- is simple to use with no prior installation or adaptation needed and;
- is small and easy to package and carry in a hand luggage.

It is an object of preferred embodiments of the present invention to provide a device which meets at least some of the above requirements.

SUMMARY OF THE INVENTION

The present invention provides a support for the neck and head of a human being, comprising a right and a left elongate support member, wherein

- the support further comprises a collapsible intermediate section interconnecting the right and left support members;

the support members are adapted to extend in the human being's cranial-caudal direction and to support a right and a left portion of the back head and neck;

at transitions between the intermediate section and the support members, the support members define left and right edges for engaging the human being's neck and mastoid bones behind the human being's ears to provide a support for the human being's head when the support is under pressure from the human being's head and neck;

each of the support members and the intermediate section is sufficiently bendable to conform to the natural contour of the left and right neck and head portions of the human being.

In the support of the invention, the neck and head are supported in such way that they rest in a fixed, natural position allowing the human being's muscles and in particular the spine to relax. Furthermore, the head may rest not only in a forwardly-facing straight position but also in various sideward turned and tilted positions to avoid pain occurring when the head is held in the same position for a longer period of time. It will be appreciated that preferred embodiments of the present invention provide an upward pressure on the occipital ridge and mastoid bones behind the human being's ears preventing the back head from dropping backwardly and/or downwardly during sleep. Such dropping of the back head may awake the sleeping human being or will cause the mouth to open during sleep. The upward pressure on the occipital ridge and the mastoid bones is created as the support members provide an upwards biasing force when they are in a fixed and bent configuration between the seat's back rest and the human being's back head and neck.

The elongate support members provide a two-directional support of the back head, i.e. a support in a sideways direction and a support in an upward direction. Preferably, the support members extend the entire length from immediately above the human being's shoulders to the occipital ridge following the specific natural contour of the left and right neck and head portions of the human being.

Finally, preferred embodiments of the support are discrete in use, easy to carry and easy to clean.

The support provided by the support members is preferably a stable support, i.e. a firm support, preferably an essentially incompressible support which is bendable and possibly also yielding. In case the support is compressible, e.g. due to inflated air comprised therein, its compressibility should be so limited that the supports do not collapse under the weight of a seated person leaning his or her head backwards against the supports.

The support members may be made from a flexible but yet rigid foam, e.g. a closed-cell foam, or from sheets of fabric, e.g. cotton, rolled up to form cylinders, bags stuffed with such materials or fabrics, felt rolls, etc.

It has been found that, in order to provide a comfortable support for the human being's head, a support of the neck and mastoid bones behind the ears is sufficient to maintain the head in a relaxed condition. Thus, in preferred embodiments, the support is dimensioned to extend only behind the human being's ears, with no portion of the support supporting or touching the human being's cheeks or jaws or covering the ears during use. It is thereby achieved that the support on the one hand provides a stable and comfortable support for the human being's head, and on the other hand does not touch those portions of the head which may be provided with make-up, after-shave or like substances, and/or does not leave pressure marks on such parts of the head. Depositing of such substance on the surface of the neck support should be avoided not only to maintain the human being's appearance, but also for hygienic reasons. Further, as the support extends only behind the human being's ears it is discrete in use, and its outer dimensions are relatively small compared to more bulky prior art devices, thereby allowing more convenient transport thereof, for example in the hand luggage of an airplane passenger.

The intermediate section is preferably arranged to draw the support members against each other when the head and neck of the individual rest against the intermediate section causing the support members to adapt to the natural contour of the left and right neck and head portions of the human being.

The physical properties of the support are preferably such that, when it is placed between the human being and the fixed support surface in a bent configuration to conform to the natural contour of the neck and head of the human being, the support provides a pressure on the occipital and mastoid bones of the head and the back top of the shoulders of the human being in the cranial-caudal direction. Such a pressure may derive from the material characteristics of the material of the elongate support members, i.e. from a biasing force or spring force provided by the elongate support members.

The intermediate section may be foldable, so that the support can be folded from its configuration of use, in which the support members are at a substantial mutual distance, to a folded configuration, in which the support members are immediately next to each other, so that there is a region of overlap between the left and the right support member.

Preferably, the support members and the intermediate section are bendable in their entire lengths to at least 90 degrees in more than one direction to conform to the natural contour of the left and right neck and head portions of various sizes of a human being.

In the support, the intermediate section may comprise a bag defining one single compartment accommodating the support members. In another embodiment, the intermediate section comprises a sheet of material, which interconnects the support members or two bags, each of which accommodates one of the support members.

Each support member may define an upper and a lower end portion, and the intermediate section preferably at least interconnects the upper end portions of the support members and their lower end portions. The intermediate section may form a bag defining one single compartment accommodating the support members. The intermediate section may comprise a sheet of material, which interconnects two bags, each of which accommodates one of the support members.

The support may further comprise at least a first and a second rigid rod-like member essentially non-bendable by the weight of the head of a human being, extending essentially parallel to the support members or within the support members for providing a rigid support to support the human being's head when it extends above the high-back of a seat. In one embodiment the ridged rod-like member may be a brace. The rigid rod-like members may be embedded in each one of the support members and in another embodiment accommodated in bags formed in the support. In use, the rod-like members preferably extend from a position below the human being's neck, at which they rest against the back rest of the human being's seat, to a position at which they engage the human being's mastoid bones and neck. For example, the rod-like members may extend the entire length of the elongate support members. Embodiments of the present invention incorporating the rod members are particularly useful to tall persons, who are unable to benefit from those types of supports which are provided by e.g. airplane or train seats.

Preferably, the rod-like members are arranged such that they can be separated from the support.

The present invention also provides a use of the support, wherein the support is used for supporting an individual's back head and neck, whereby during the use the support members extend in the human being's cranial-caudal direction and support a right and a left portion of the back head and neck. The individual may be in a seated, prone or supine position. When the individual is in a supine or seated position, the support members are used to provide a pressure on the occipital bone of the head and the back top of the shoulders of the human being in the cranial-caudal direction.

In a final aspect, the invention provides a method of supporting the neck of an individual with the aid of a support comprising a right and a left elongate support member, and a collapsible/foldable intermediate section interconnecting the right and left support members; the support members being adapted to extend in the human being's cranial-caudal direction and to support a right and a left portion of the back head and neck; whereby, at transitions between the intermediate section and the support members, the support members define left and right edges for engaging the human being's neck and mastoid bones behind the human being's ears to provide a support for the human being's head when the support is under pressure from the human being's head and neck; each of the support members and the intermediate section being sufficiently bendable to conform to the natural contour of the left and right neck and head portions of the human being.

BRIEF DESCRIPTION OF THE DRAWINGS

Preferred embodiments of the invention will now be described with reference to the drawings, in which.

DETAILED DESCRIPTION OF THE DRAWINGS

Figure 1:
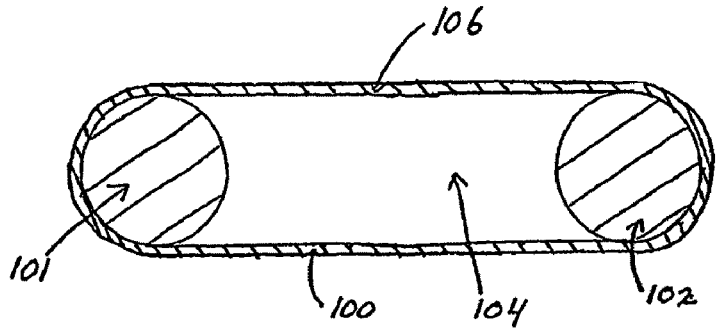
FIG. 1 shows a longitudinal cross-section through a preferred embodiment of the support with cylindrical support members.

Referring FIG. 1, there is disclosed a support for supporting the neck and head of a human being, the support comprising a right and a left elongate support member 101 and 102, respectively, and a collapsible or foldable intermediate section 100 and 106 connecting the right 101 and left 102 support members and arranged to control the maximum transverse distance between the support members 101 and 102. The intermediate section 100 and 106 can be arranged to draw the support members 101 and 102 towards each other when the head and neck of the individual is put to rest against the intermediate section 106 thereby pressing it down between the support members 101 and 102.

The dimensions of the support members 101 and 102 and the intermediate section 100 and 106 are such that the individual's head and neck are at least partly secured in a transverse direction between the support members when the head and neck rest against the support and when the support members 101 and 102 extend in the individual's cranial-caudal direction with a left and right portion of the individual's back head resting against one or both of the support members 101 and 102. The support members preferably have a length sufficient to allow them to extend from a position immediately above the human being's shoulders up to at least occipital ridge behind the ears following the specific natural contour of the left and right neck and head portions of the human being. Hence, the length of the support members is in the range of 7-20 cm for infants, and 12-40 cm for adults. The diameter of the support members is preferably in the area of 0.5-5 cm, preferably 2-3 cm. The width of the support is not much wider than the width of the back head of a human being, e.g. 8-20 cm for adults or 4-15 cm for infants.

Preferably, the measurements of the support do not exceed 20 (width)×40 (length)×5 (depth) centimeters.

The intermediate section may have a thickness of at most 2 centimeter, such as at most 1.5 centimeter when the intermediate section is under pressure from the head and neck of a human being. In order to reduce the space occupied by the support, it may be preferable that the intermediate section is as thin as possible. However, if the support is to be used on hard surfaces, the intermediate section may advantageously include a stuffing of a relatively soft material of a certain thickness and/or a volume of inflated air.

The above considerations regarding dimensions generally apply to all embodiments of the present invention.

The intermediate section 100 and 106 is preferably in the form of a bag with air or an empty space 104 between the sides 100 and 106 of the intermediate section. The further the upper side 106 of the intermediate section is pressed down between the support members 101 and 102, the closer the support members 101 and 102 will be drawn against each other to provide the maximum capability of the support to conform to the natural contours of the neck and head portions of various sizes of a human being and of providing a firm and stable support. Consequently, the larger the diameter of the support members are, the further the support members will be drawn against each other when the intermediate section is in the form of a bag.

Figure 2:
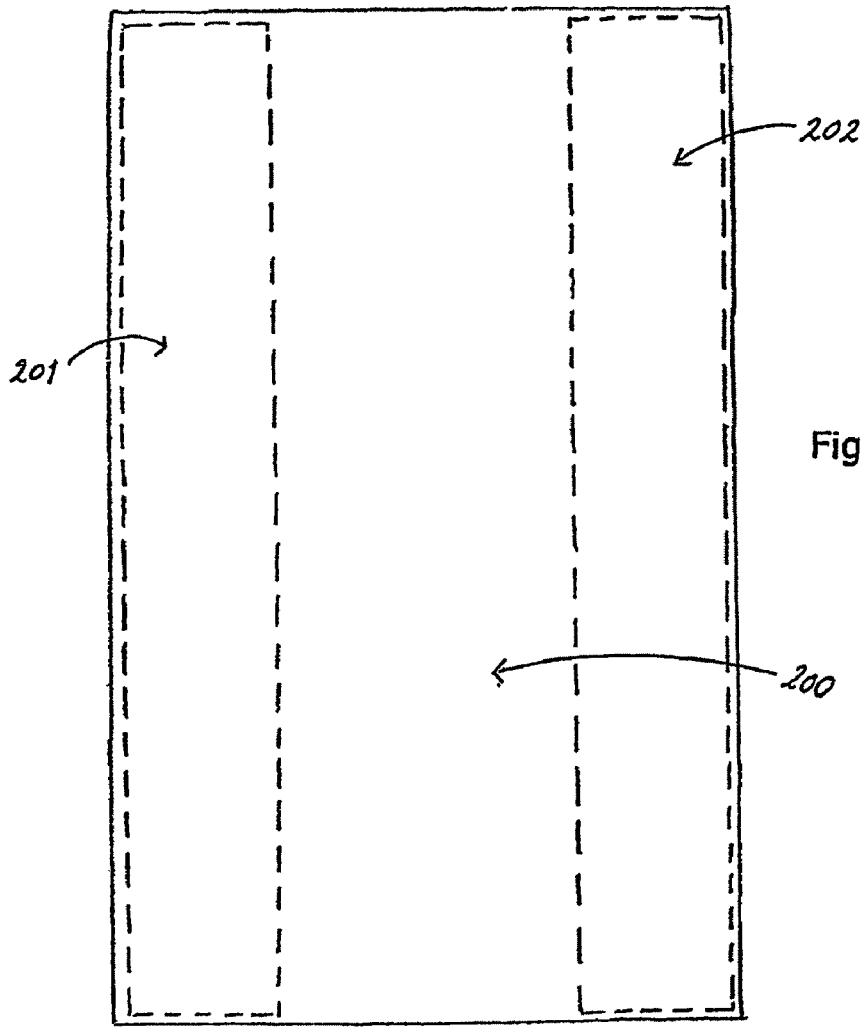
FIG. 2 shows a preferred embodiment of the support with the two elongated support members located in each side of the support.

FIG. 2 shows how the support members 201 and 202 are located in each side of an embodiment of the support the support members being interconnected by a foldable/collapsible intermediate section 200 comprising a bag. In this embodiment of the support the support members are not fixed within the bag and can easily be removed through an opening in the bag, the opening being optionally provided with a lid, e.g. when the bag is to be cleaned. The support members are pushed to the respective sides of the support when prepare for use. When the support is not in use, the bag can be used to store other items than the support members including the rigid rod-like members described below with reference to FIGS. 8 and 9.

Figure 3:
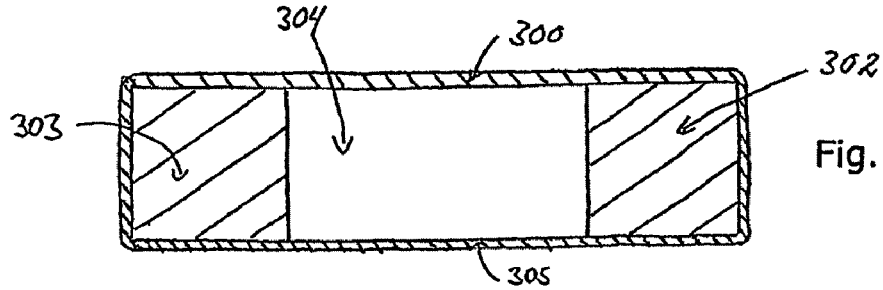
FIG. 3 shows a longitudinal cross-section through an embodiment of the support with support members having a square cross-section.

FIG. 3 shows an embodiment of the support with square support members 302 and 303 being connected by a foldable/collapsible intermediate section 300 with air or an empty space between the upper first side 300 of the intermediate section the lower second side 305 of the intermediate section.

Figure 4:
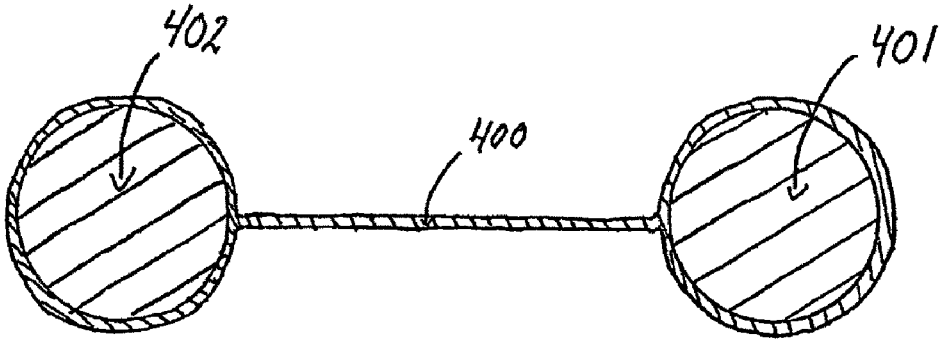
FIG. 4 shows a longitudinal cross-section through another embodiment of the support where the two support members are interconnected by a single piece of sheet material.

FIG. 4 shows an embodiment of the support wherein the intermediate section is in the form of a foldable or collapsible sheet or strap rather than a bag connecting the support members 401 and 402.

Figure 4A:
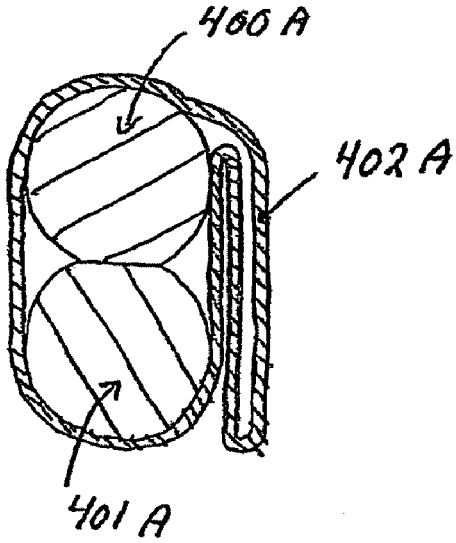
FIG. 4A shows an embodiment of the support folded from its configuration of use to a collapsed configuration for carriage/storage.

FIG. 4A shows an embodiment of the support folded from its configuration of use, in which the support members 400A and 401A are located immediately next to each other, and wherein the intermediate section 402A in the form of a bag is folded. The support is folded for carriage and storage. Buttons, a strap or other lock mechanism may maintain the support in the folded position.

It is preferred that, when the bag is in its folded configuration, the support in its entire length has a diameter of no more than 10 centimeters.

Figure 5:
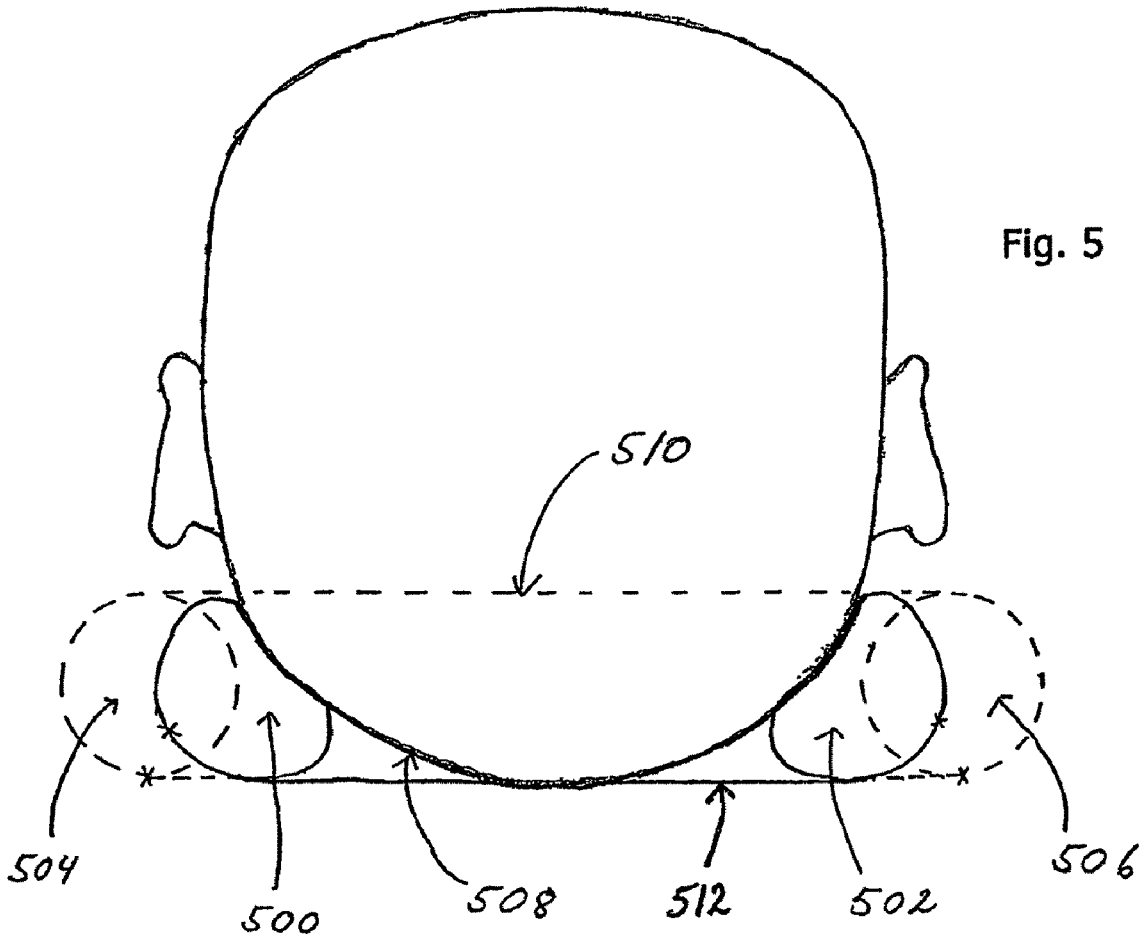
FIG. 5 is a top view of the head of a human head properly supported by the support of the present invention with an indication of the position of the support members before the head is put to rest on the support.

FIG. 5 shows an embodiment of the support is use. The elongated support members 500 and 502 are drawn against each other from their initial positions 504 and 506 to provide support for the neck and head when the head and neck of the individual is put to rest against the intermediate section 508 pressing it from it initial position 510 down between the support members 500 and 502. The support hereby conforms itself to the width and contour of the neck and back head of the individual.

Figure 10:
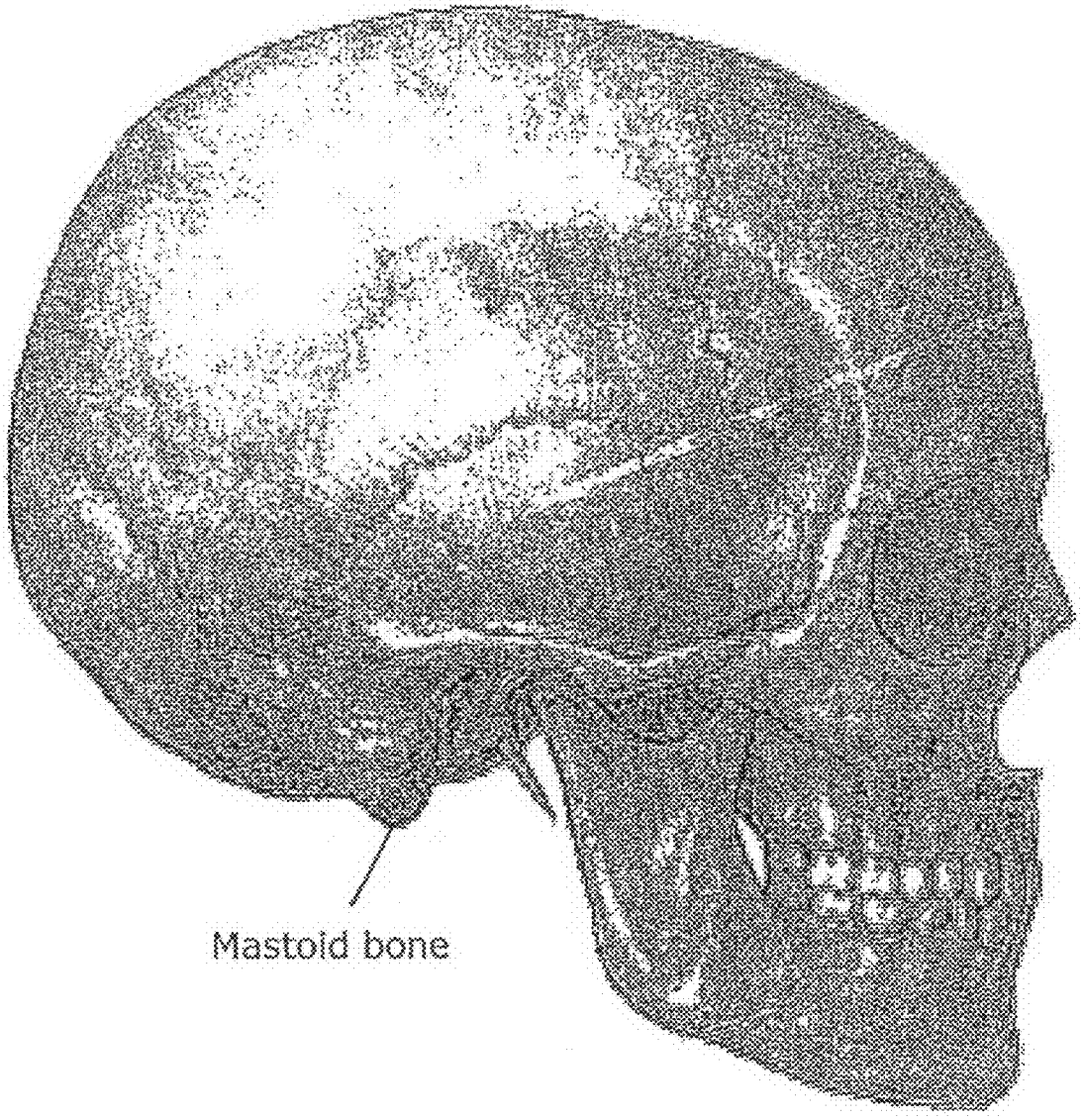
FIG. 10 illustrates the human cranium in a side view.
Figure 11:
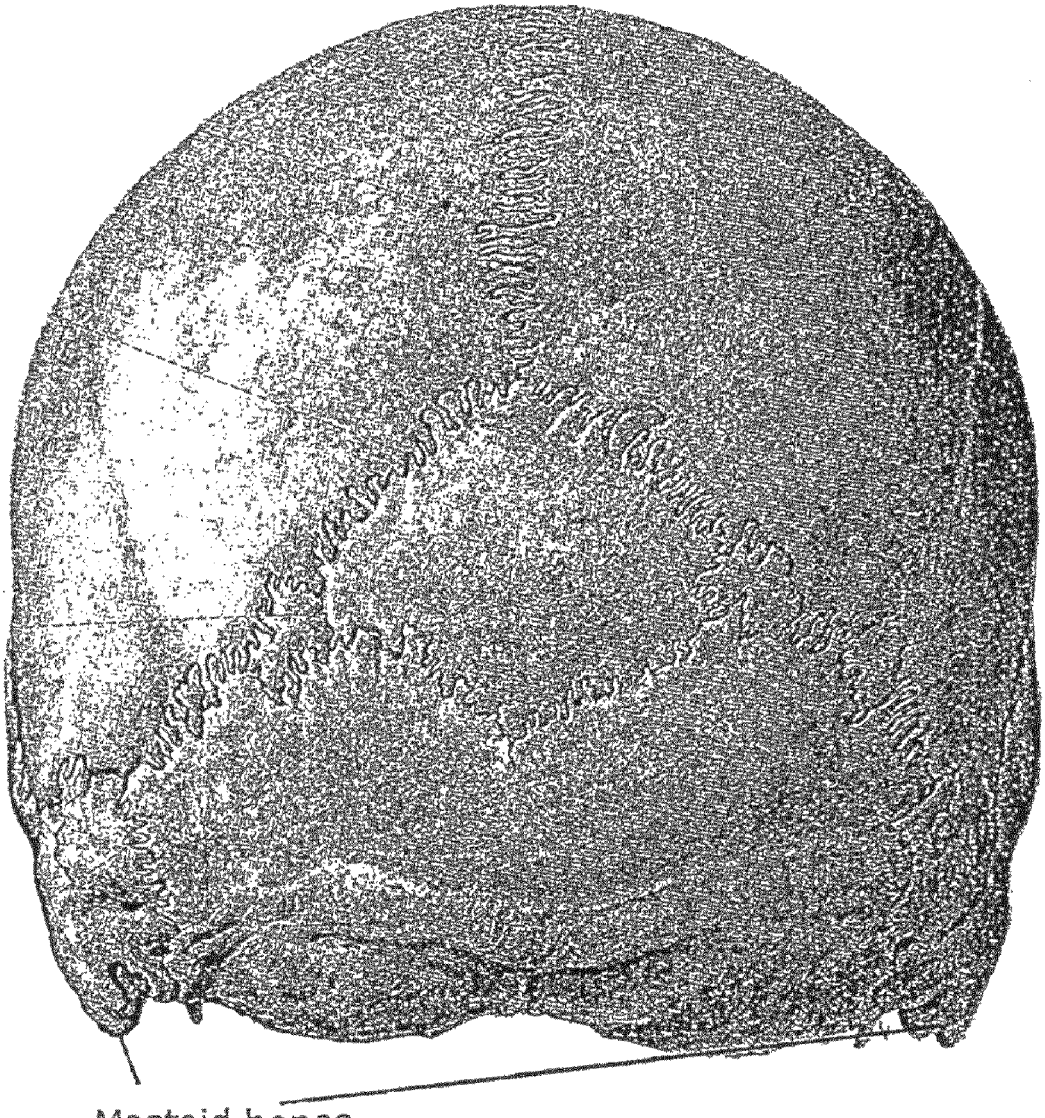
FIG. 11 illustrates the human cranium seen from behind.

In the transitions between the intermediate section 508 and 512 and the support members 500 and 502, the support members are essentially incompressible under the weight of the head and define left and right edges—when the intermediate section 510 and 512 is pressed against a fixed support surface (e.g. the back of a chair)—for engaging the human being's neck and mastoid bones behind the human being's ears to provide a firm support for the human being's neck and head portions when the support is under pressure from the human being's head and neck. The support members 502 and 500 prevent the head from rolling to either side and. hold the neck and head in a given sideward turned and tilted position in a firm secured grip. The human being's mastoid bones are illustrated in FIGS. 10 and 11.

Figure 6:
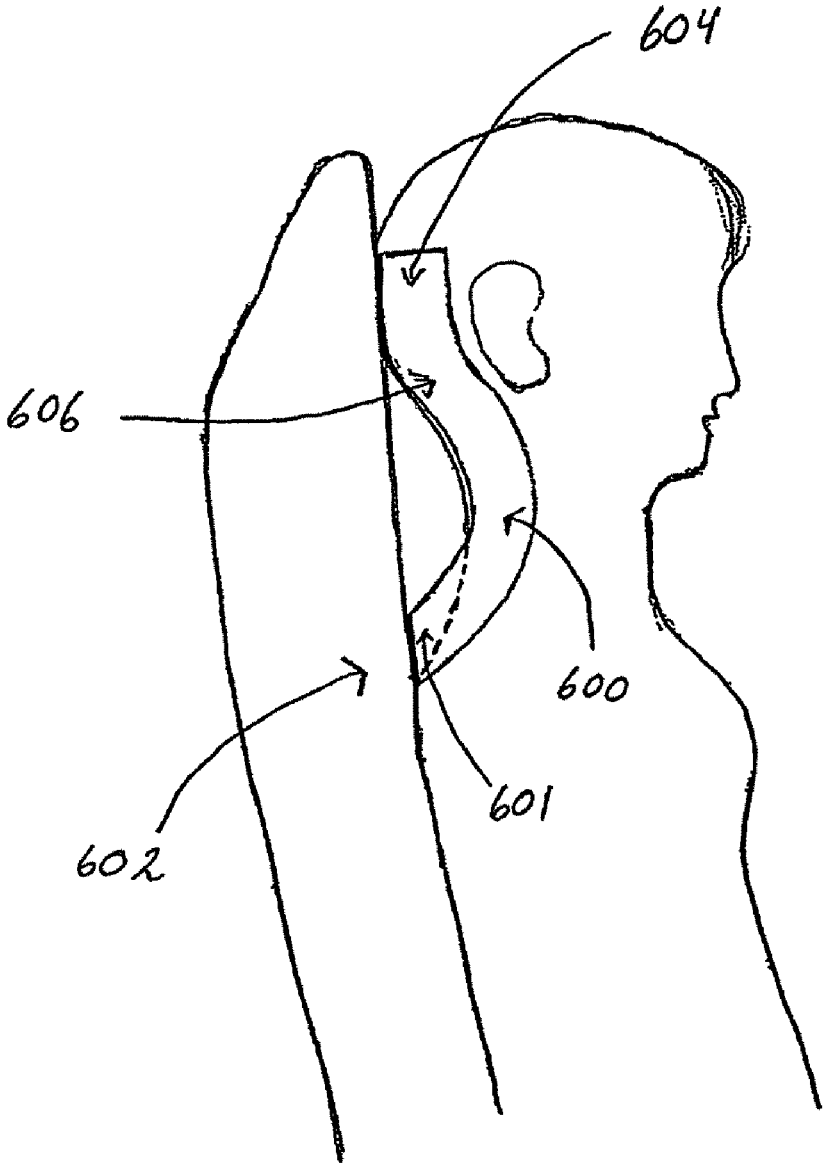
FIG. 6 is a side view from the side of an individual with the head and neck properly supported by the support of the present invention.

FIG. 6 illustrates how the support 600 when in use is bended to conform to the natural contour of the neck and back head the human being, with one end of the support 601 placed on the lower part of the neck of the individual and resting against the support surface 602 (e.g. the high back of a seat) on which the person is resting and the other end of the support 604 placed on the back head of the individual. Due to the firmness of the two support members (e.g. 201 and 202 in FIG. 2) and the consequent natural resistance to the bended position, the support provides a nest 606 for and a slight upwards pressure on the occipital ridge/lower back skull of the individual preventing the head from slipping backwards out of its natural posture. The occipital ridge is illustrated in FIG. 11. As illustrated in FIG. 6 the support allows the head to remain resting on the original back-headrest of the seat i.e. the head is not pushed forward causing it to drop on the chest of the individual during sleep in an almost vertical positioned seat, e.g. an airplane seat in its upright position.

The support members 201 and 202 are preferably bendable in their entire length to at least 90 degrees in more than one direction to conform to the different contours of the neck and head when the head is positioned in different natural sideward turned and sideward tilted positions.

Figure 7:
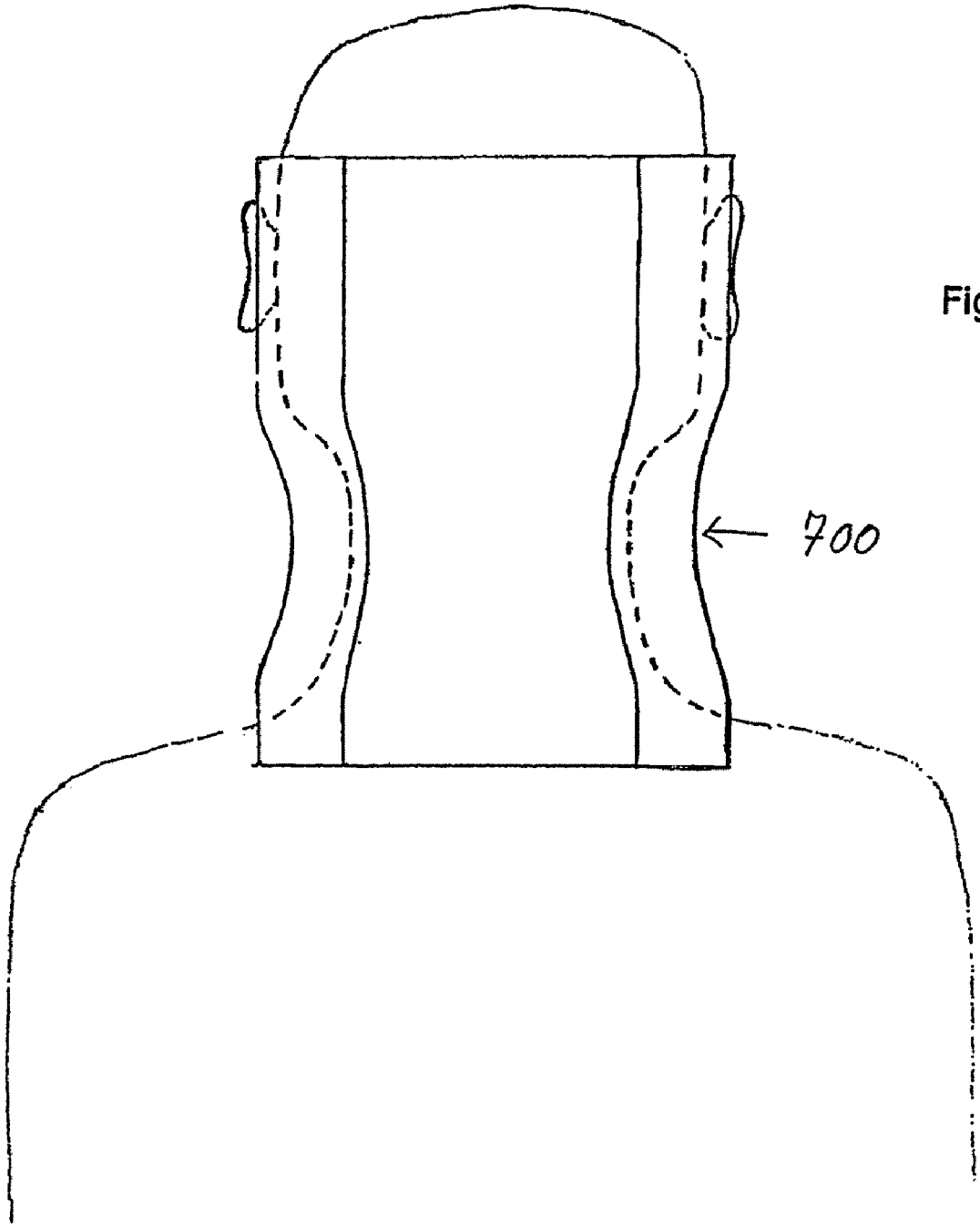
FIG. 7 is a side view from the back of an individual with the neck and head properly supported by the support of the present invention.

FIG. 7 illustrates how due to the narrower contour of the neck than the back head of an individual, the neck presses the intermediate section 106 further in between the support members 201 and 202 and draw the support members closer against each other where the neck rests on the support 700 providing a firm support of the entire neck as well as the head.

Figure 8:
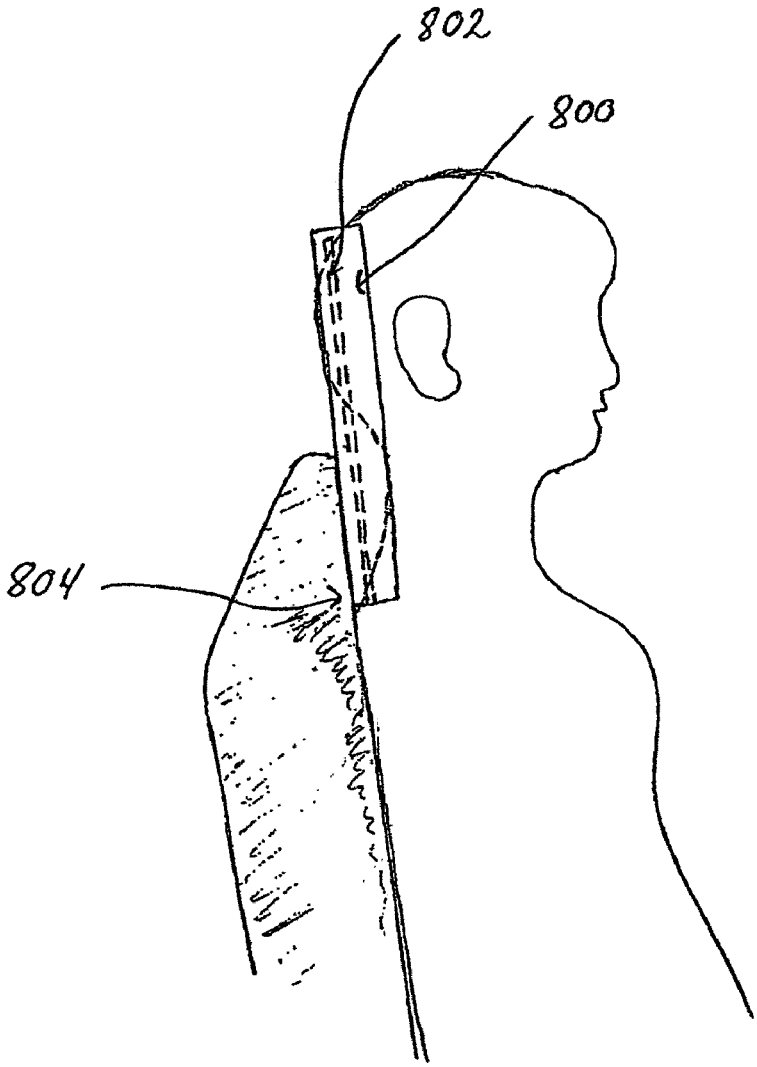
FIG. 8 is a profile view from the side of an individual with the head properly supported by an embodiment of the support including two rigid rod-like members extending essentially parallel to the flexible support members providing a rigid support for the head which extends above the high-back of a chair.

FIG. 8 illustrates how the support 800 works when it further comprises a right and a left rigid rod-like member 802 extending essentially parallel to the support members for providing a rigid support for the head when the head of the individual reaches above the headrest of the seat. The support is held in place by the upper part of the shoulders and the weight of the individual, which form a counter weight to the upper part of the rigid support 800 when it supports the head of the individual.

Figure 9:
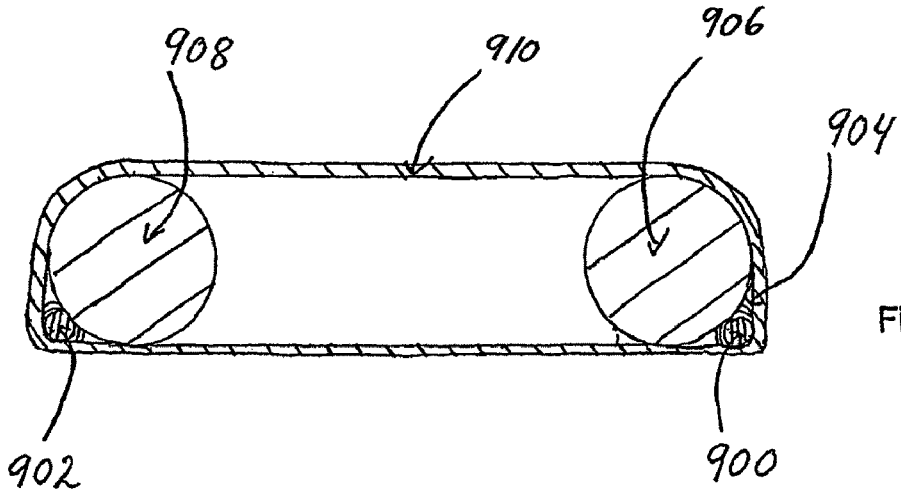
FIG. 9 shows a preferred embodiment of the support of FIG. 8 with the two elongated support members and two rigid rod-like members located in each side of the support.

FIG. 9 illustrates an embodiment of the support with rigid elongated cylindrical members 900 and 902 pocketed in small pockets in the bag 910 comprising the support members 906 and 908. The rigid members may in another embodiment be pocketed in a pocket in the support members 906 and 908.

As mentioned above, FIGS. 10 and 11 illustrate the human cranium, including the mastoid and occipital bones as well as the occipital ridge.

From the above disclosure, it will be apparent that the preferred embodiments of the present invention provide a number of features and advantages, including that:

(i) the head may be supported sideways by a firm engagement of the left and right support members with the mastoid bones behind the ears (the right and left back part of the head) rather than engaging with and supporting the sides (ears, jaws and/or cheeks) of the head;

(ii) an upward flexible pressure/support may be provided (not merely a fixed support) on the occipital ridge and mastoid bones behind the ears (back head) preventing the back head from dropping back and downwards (which is uncomfortable and will cause the mouth to open) during sleep, the pressure being created when the support members are fixed in a bent configuration between the back seat and the neck and back head of the human being;

(iii) a sideways and upwards support of the back head is provided simultaneously;

(iv) small elongated support members are provided, which due to their flexibility and yet springy nature provide a firm support which automatically adapts to the specific natural contour of the entire part (not just some part) of the back of the neck and head of the specific human being using it (from the top of the shoulders to the occipital ridge); and (v) a feature is provided, which allows the support to extent beyond the top part of the back seat thereby providing a support for the heads of people who are too tall to benefit from the support of the back seat.

The invention claimed is:

1. A support for the neck and head of a human being, comprising a right and a left elongate support member; wherein:

the support further comprises a collapsible intermediate section interconnecting the right and left support members;

the support members are adapted to extend in the human being's cranial-caudal direction and to support a right and a left portion of the back head and neck;

the support is dimensioned to extend only behind the human being's ears, with no portion of the support supporting or touching the human being's cheeks or jaws during use;

the support members are incompressible under the weight of the head of a human being;

at transitions between the intermediate section and the support members, the support members define left and right edges for engaging the human being's neck and mastoid bones behind the human being's ears to provide a support for the human being's head when the support is under pressure from the human being's head and neck;

each of the support members and the intermediate section is sufficiently bendable to conform to the natural contour of the left and right neck and head portions of the human being;

the material characteristics of each of the support members are such that the support members provide a biasing force on the human being's occipital and mastoid bones during use of the support.

2. A support according to claim 1, further comprising a right and a left rigid rod-like member extending essentially parallel to the support members for providing a rigid support.

3. A support according to claim 1, wherein the support members are bendable to at least 90 degrees in more than one direction.

4. A support according claim 1, wherein the support members have a diameter of at most 5 centimeters.

5. A support according to claim 1, wherein the intermediate section has a thickness of at most 1.5 centimeter, when the intermediate section is under pressure from the head and neck of a human being.

6. A support according to claim 1, wherein the physical properties of the support are such that, when it is placed between the human being and the fixed support surface in a bent configuration to conform to the natural contour of the neck and head of the human being, the support provides a pressure on the occipital and mastoid bones of the head and the back top of the shoulders of the human being in the cranial-caudal direction.

7. A support according to claim 1, wherein the support members are arranged such that the transverse distance between them is variable.

8. A support according to claim 1, wherein the intermediate section is foldable, so that the support can be folded from its configuration of use, in which the support members are at a substantial mutual distance, to a folded configuration, in which the support members are at immediately next to each other, so that there is a region of overlap between the left and the right support member.

9. A support according to claim 1, wherein the intermediate section is in the form of at least one sheet or strap arranged to draw the support members toward each other when the intermediate section is put under pressure from the human being's head.

10. Use of a support for the neck and head of a human being, comprising a right and a left elongate support member, and a collapsible/foldable intermediate section connecting the right and left support members; whereby, at transitions between the intermediate section and the support members, the support members define left and right edges for engaging the human being's neck and mastoid bones behind the human being's ears to provide a support for the human being's head when the support is under pressure from the human being's head and neck, the support members being incompressible under the weight of the human being's head; each of the support members and the intermediate section being sufficiently bendable to conform to the natural contour of the left and right neck and head portions of the human being; for supporting an individual's back head and neck, whereby during said use the support members extend in the human being's cranial-caudal direction, the support members extending only behind the human being's ears with no portion of the support supporting or touching the human being's cheeks or jaws, and the support members supporting a right and a left portion of the back head and neck by providing an upward biasing force on the occipital ridge and mastoid bones behind the human being's ears when the support members are in a fixed and bent configuration between a fixed supporting surface and the human being's back head and neck.

11. Use according to claim 10, wherein said use causes the support members to be drawn towards each other when the head and neck of the individual rest against the intermediate section, the dimensions of the support members being such that the individual's head and neck are at least partly secured in a transverse direction between the support members when the head and neck rest against the support and when the support members extend in the individual's cranial-caudal direction with a left and right portion of the individual's back head and neck resting against a respective one of the support members.

12. Use according to claim 10 in conjunction with a supporting surface, such as a seat or mattress, wherein the support members are arranged to extend in a cranial-caudal direction, whereby a distal portion of the support members is supported by said supporting surface, and whereby a proximal portion of the support members support the individual's neck.

* * * * *